US007607654B2

(12) United States Patent
Sonoda et al.

(10) Patent No.: US 7,607,654 B2
(45) Date of Patent: Oct. 27, 2009

(54) SHEET FEEDING APPARATUS

(75) Inventors: Shinya Sonoda, Yokohama (JP); Masato Izumi, Kawasaki (JP); Takeji Niikura, Yokohama (JP); Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/772,940

(22) Filed: Jul. 3, 2007

(65) Prior Publication Data

US 2008/0012197 A1 Jan. 17, 2008

(30) Foreign Application Priority Data

Jul. 7, 2006 (JP) ..... 2006-187920

(51) Int. Cl.
*B65H 3/06* (2006.01)

(52) U.S. Cl. ..... 271/109; 271/250

(58) Field of Classification Search ..... 271/109, 271/117, 118, 248, 250–252
See application file for complete search history.

(56) References Cited

U.S. PATENT DOCUMENTS 6,382,619 B1 * 5/2002 Gustafson et al. ..... 271/117
6,503,010 B2 * 1/2003 Jeong ..... 400/629
7,147,218 B2 12/2006 Izumi et al. ..... 271/145
7,165,765 B2 1/2007 Sonoda et al. ..... 271/122
7,441,765 B2 * 10/2008 Okamoto ..... 271/121
2002/0190458 A1 * 12/2002 Gaarder et al. ..... 271/109
2005/0275154 A1 12/2005 Sonoda ..... 271/122

FOREIGN PATENT DOCUMENTS

JP 2001-151358 6/2001
JP 2001151359 A * 6/2001
JP 2002154680 A * 5/2002

* cited by examiner

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

A sheet feeding apparatus includes a driving force transmitting member for transmitting a rotational driving force to a sheet feeding roller, first and second roller supporting members for supporting the sheet feeding roller. The sheet feeding apparatus further includes supporting portions for swingably supporting the first and second roller supporting members. The first and second roller supporting members are integrally movable with respect to a motion about the supporting portions and are independently movable with respect to a motion, at the supporting portions, about an axis normal to a sheet stacking surface.

8 Claims, 7 Drawing Sheets

SHEET FEEDING APPARATUS

FIELD OF THE INVENTION AND RELATED ART

The present invention relates to a sheet feeding apparatus for picking up and feeding sheets one by one from a plurality of stacked sheets.

In a recording apparatus including a sheet feeding apparatus, examples of a type of the sheet feeding apparatus may include a type in which a sheet is fed in a horizontal state wherein sheets are substantially horizontally stacked and held at a lower portion of a main assembly of the recording apparatus, a type in which a sheet is fed in an inclined state wherein sheets are stacked and held at an inclined rear portion of the recording apparatus, and a type in which a sheet is fed in the horizontal state and/or in the inclined state. The type in which the sheet is fed in the horizontal state is a so-called U-turn sheet feeding type wherein a sheet is fed in a reverse sheet feeding manner and is suitable for feeding of thin paper such as plain paper. The type in which the sheet is fed in the inclined state can reduce a feeding load exerted on the sheet during recording, thus being suitable for a recording apparatus for printing a photographic-quality image.

A sheet feeding means provided to the sheet feeding apparatus may employ a rotatable roller method in which a shaft is fixed and a swing arm method in which a sheet feeding roller is attached to an arm which is swingable about a fixed shaft. Further, a separation means for the sheet feeding apparatus may employ various methods such as a bank separation method utilizing a resistance at a surface contactable with a leading end of a sheet, a friction plate separation method utilizing a frictional force of a separating pad, and a retarding separation method utilizing a separating roller provided with a torque limiter.

With respect to these separation methods, when a wide range of sheets from the thin paper such as the plain paper to thick paper such as glossy paper for photoprinting are separated, a higher separation reliability is ensured in the order of the retarding separation method, the friction plate separation method, and the bank separation method. However, this order is reversed in terms of cost. For this reason, in a sheet feeding mechanism used for feeding principally the thin paper such as the plain paper, the bank separation method is employed in many cases. Further, in these cases, as the sheet feeding means, a swing arm type sheet feeding means which does not requires a press-contact plate and a cam mechanism and can be constituted relatively easily is frequently employed.

The swing arm type sheet feeding means may ordinarily employ a constitution as described in Japanese Laid-Open Patent Application (JP-A) No. 2001-151358. FIG. 9 is a front view showing a swing arm type sheet feeding means as described in JP-A No. 2001-151358. In FIG. 9, a sheet feeding roller 112 is attached to a swing arm 111 swingably attached to a driving shaft 110.

The swing arm type sheet feeding means is a so-called pendulum sheet feeding roller provided to one end of a swing arm supported by a driving shaft at the other end. For this reason, in order to feed a sheet in a straight line with no oblique movement during the sheet feeding, perpendicularity of a rotation shaft of the sheet feeding roller with respect to a sheet feeding direction is an important factor. For example, when the perpendicularity of the rotation shaft of the sheet feeding roller with respect to the sheet feeding direction is deviated, the sheet is fed while causing the oblique movement. As a result, inconvenience such as lateral deviation of a leading end margin and a recording result inclined with respect to the sheet can be caused to occur. When only one of right and left sides of the sheet feeding roller contacts the surface of the sheet, the sheet is obliquely fed, so that the lateral deviation of the leading end margin and the recording result inclined with respect to the sheet can be caused to occur in a subsequent printing step after the feeding step. In order to obviate these inconveniences, the conventional constitution has been required to improve parts accuracy. Further, the conventional constitution has also been required to keep the perpendicularity of the rotation shaft of the sheet feeding roller with respect to the sheet feeding direction during parts adjustment and assembly and parts alignment.

SUMMARY OF THE INVENTION

A principal object of the present invention is to provide a sheet feeding apparatus capable of causing a sheet feeding roller to press-contact a sheet laterally uniformly to realize a stable sheet feeding operation while preventing an occurrence of oblique movement of the sheet.

Another object of the present invention is to provide a recording apparatus using the sheet feeding apparatus.

According to an aspect of the present invention, there is provided a sheet feeding apparatus comprising:

a sheet stacking portion for stacking a sheet;

a sheet feeding roller for feeding the sheet stacked on the sheet stacking portion;

first and second arms for rotatably supporting said sheet feeding roller; and a supporting portion for swingably supporting the first and second arms, wherein the first and second arms are integrally movable with respect to a motion about the supporting portion and are independently movable with respect to a motion, at the supporting portion, about an axis normal to the sheet stacked on the sheet stacking portion.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
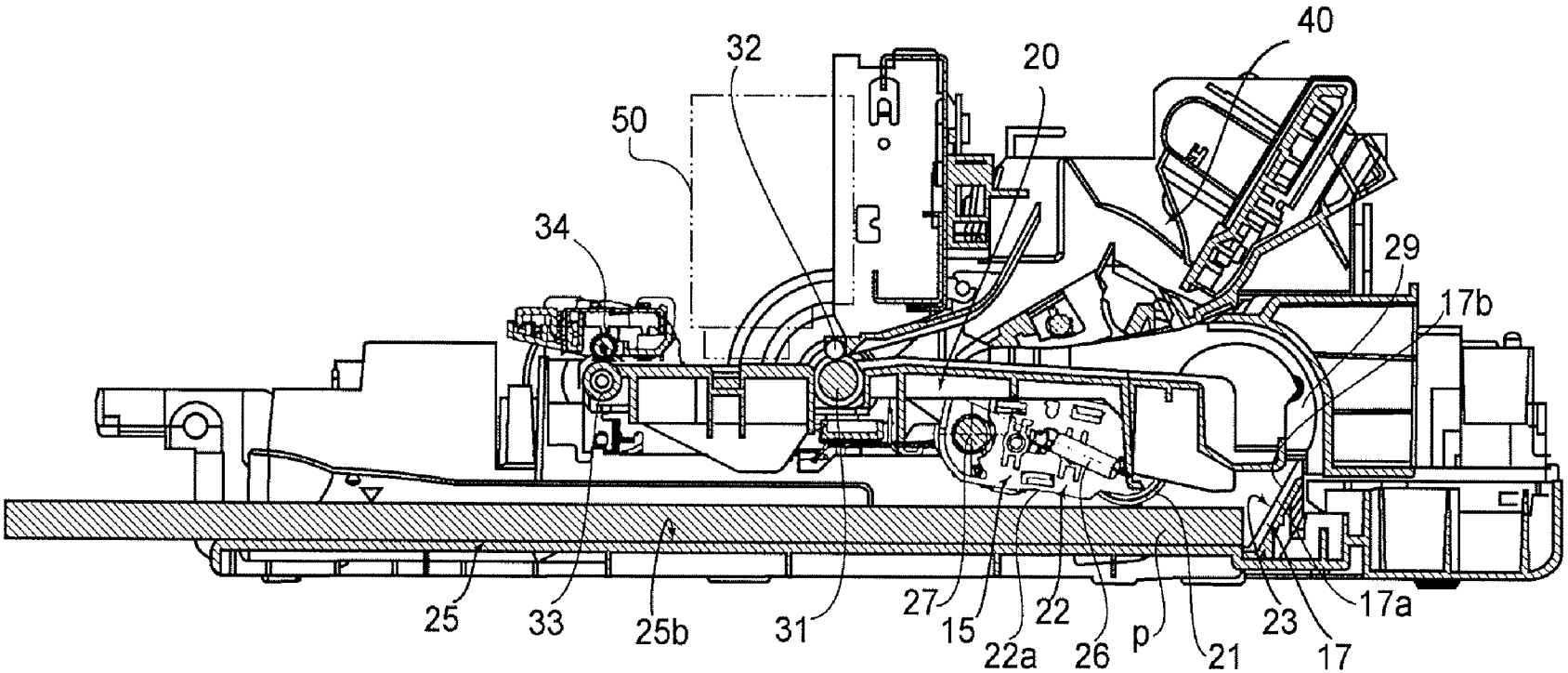
FIG. 1 is a longitudinal sectional view showing an embodiment of a sheet feeding apparatus to which the present invention is applied.

Hereinbelow, embodiments of the present invention will be described more specifically with reference to the drawings. In the drawings, identical reference numerals or symbols represent identical or corresponding portions. FIG. 1 is a longitudinal sectional view showing an embodiment of a sheet feeding apparatus to which the present invention is applied. Referring to FIG. 1, sheets P stacked on a sheet stacking portion 25 is fed and separated one by one by a sheet feeding means 15 and then is fed to a nip between a conveying (feeding) roller 31 and a pinch roller 32. Thereafter, the conveying roller 31 and the pinch roller 32 are synchronously driven to convey the fed sheet S through a recording portion or reading portion 50. The sheet P subjected to image recording with an unshown recording head or subjected to image reading at the recording portion or reading portion 50 is discharged to the outside of a main assembly of the sheet feeding apparatus through a nip between a sheet discharge roller 33 and a spur 34. The sheet stacking portion 25 is constituted so that the sheets P are stacked and held substantially horizontally with respect to a mounting surface at which a recording apparatus is mounted. For this reason, even when the sheets P are stacked for a long period of time, it is possible to suppress distortion or strain generated with respect to the sheets P as small as possible.

In this embodiment, a swing arm type sheet feeding means 15 for feeding sheets by driving a sheet feeding roller 20 shaft-supported by a swing arm 22 is used. The swing arm type sheet feeding means 15 is provided with the swing arm 22 rotatably supported by a supporting portion constituted by supporting shafts 20*a* and 20*b* provided to a sheet feeding base 20. This swing arm 22 is constituted by a right arm 22*a* as a first roller supporting member and a left arm 22*b* as a second roller supporting member in combination. The sheet feeding roller 21 is rotatably supported by the right arm 22*a* and the left arm 22*b*. Further, to the right arm 22*a*, a driving force transmitting means such as idler gears 28 and the like for transmitting a driving force to the sheet feeding roller 21 is provided.

The right arm 22*a* is rotatably engaged with and supported by the supporting shaft 20*a* provided to the sheet feeding base 20, and the left arm 22*b* is rotatably engaged with and supported by the supporting shaft 20*b* provided to the sheet feeding base 20. That is, the supporting shafts 20*a* and 20*b* constitute the supporting portion for swingably supporting the right arm 22*a* and the left arm 22*b*. In the neighborhood of an end of the sheet stacking portion 25, a separating means for separating an uppermost (top) sheet from sheets fed by the sheet feeding roller 21 is provided. In this embodiment, the separating means employs a bank separation type which is advantageous in terms of cost and includes a leading end reference portion 23 constituted by a bank-like sheet. The bank separation type is principally suitable for thin paper such as plain paper.

The sheet feeding apparatus includes the sheet stacking portion and a sheet feeding/separating portion and ordinarily further includes a conveying (feeding) path for sending sheets to the conveying roller. First, the sheet stacking portion 25 will be described. The sheet stacking portion 25 includes a sheet stacking surface 25*b* for substantially horizontally holding a plurality of sheets with a recording surface as a downward surface and the leading end reference surface 23 for regulating a leading end position of the stacked sheets. The leading end reference portion 23 includes a bank formed as an inclined surface with ribs or the like and constitutes the separating means together with the sheet feeding roller 21. The sheets stacked on the sheet stacking surface 25*b* are horizontally stacked substantially in parallel with a horizontal surface of the recording apparatus, so that the sheets are urged downwardly by gravitation. Leading ends of the stacked (set) sheets are held in a state in which the leading ends are caused to abut against the leading end reference portion 23.

In this embodiment, in order to reduce a resistance load exerted on the sheets during a sheet feeding operation, the leading end reference portion 23 is constituted by a plurality of ribs extending in a sheet feeding direction and a separating surface is constituted by upper surfaces of the respective ribs. Further, it is also possible to employ a constitution in which a part of the ribs is caused to have a shape including projections and recesses with respect to the sheet feeding direction, so that a predetermined separation resistance is stably generated to smoothly separate the uppermost sheet from second and subsequent sheets. As shown in FIG. 1, in a standby state, the sheet feeding roller 21 is held in contact with the uppermost sheet. For this reason, at the same time when rotation of the sheet feeding roller 21 is started, it is possible to start the sheet feeding operation without actuating other movable parts. When the sheets P are stacked or added onto the sheet stacking portion 25, the sheets may be pushed into the sheet stacking portion 25 as they are. More specifically, when the sheets are pushed into the sheet stacking portion 25 along the sheet stacking surface 25*a*, the sheet feeding roller 21 is raised, so that the swing arm type sheet feeding means 20 is rotated upwardly about the supporting shafts 20*a* and 20*b*. In this case, the swing arm swings with the raising of the sheet feeding roller 21, so that it is not necessary to employ a particular constitution for moving the sheet feeding roller 21 apart from the sheets.

Figure 2:
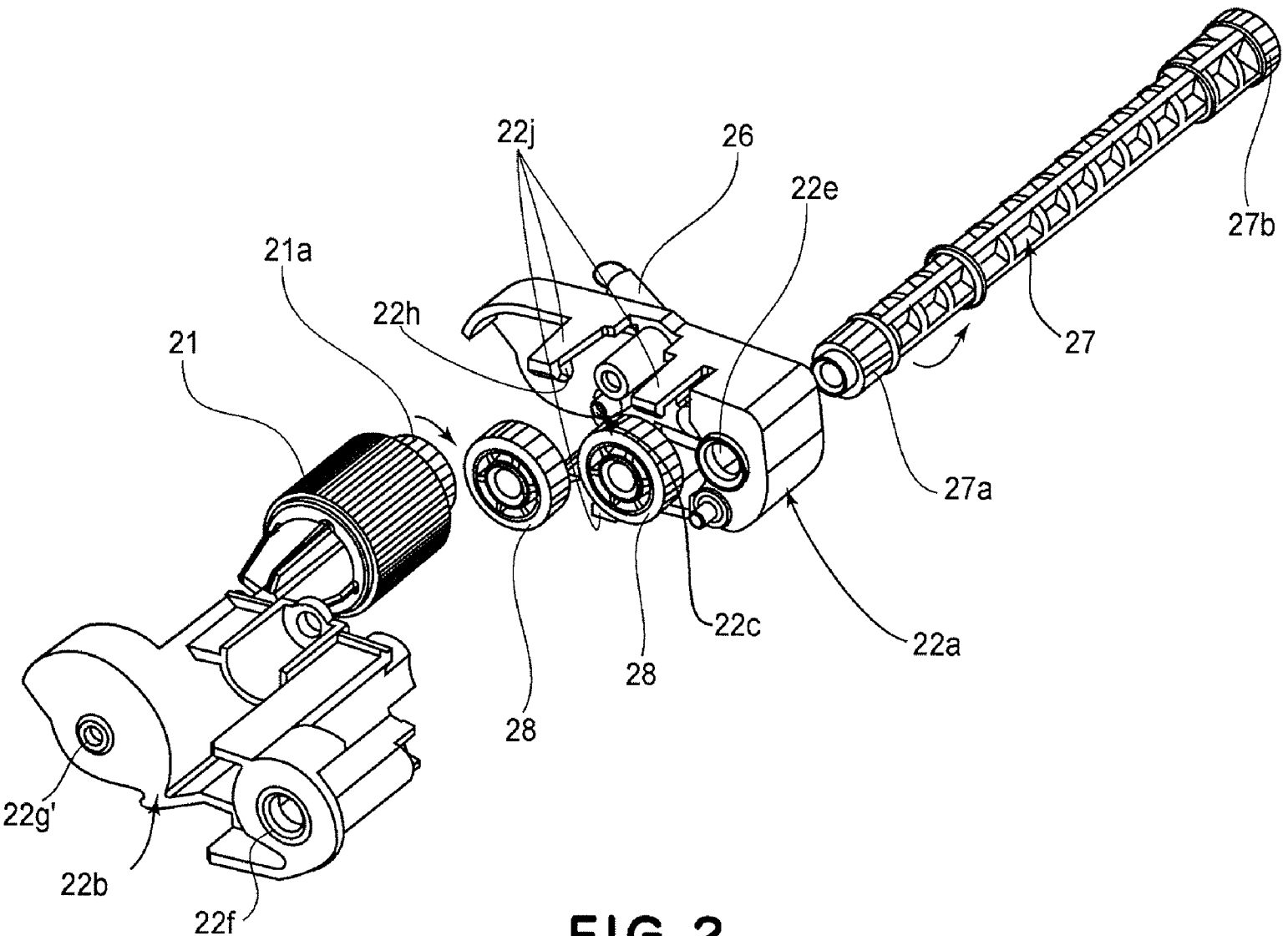
FIG. 2 is an exploded perspective view showing constitutional parts of a swing arm type sheet feeding means shown in FIG. 1.
Figure 3:
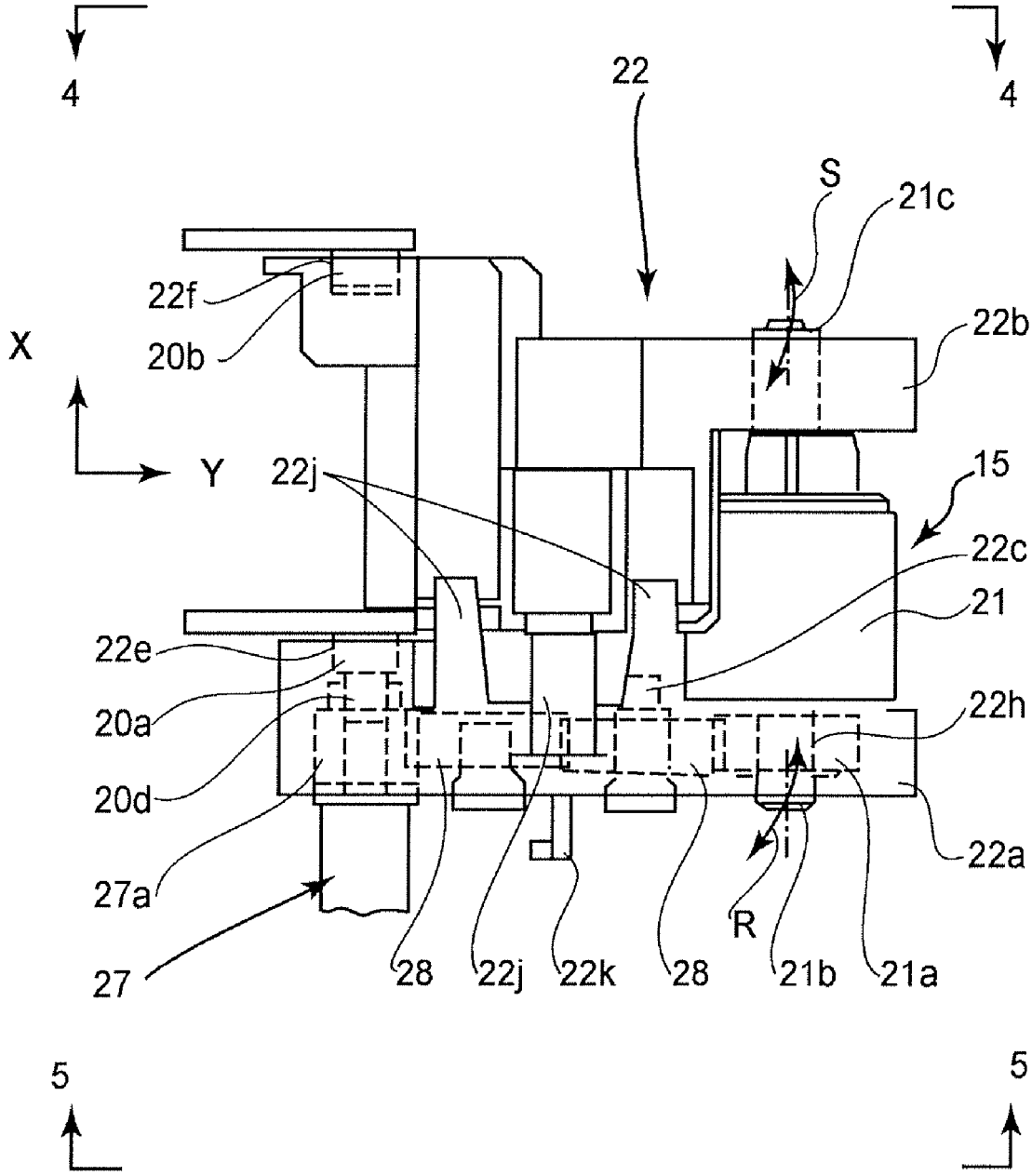
FIG. 3 is a plan view of the swing arm type sheet feeding means shown in FIG. 2.
Figure 4:
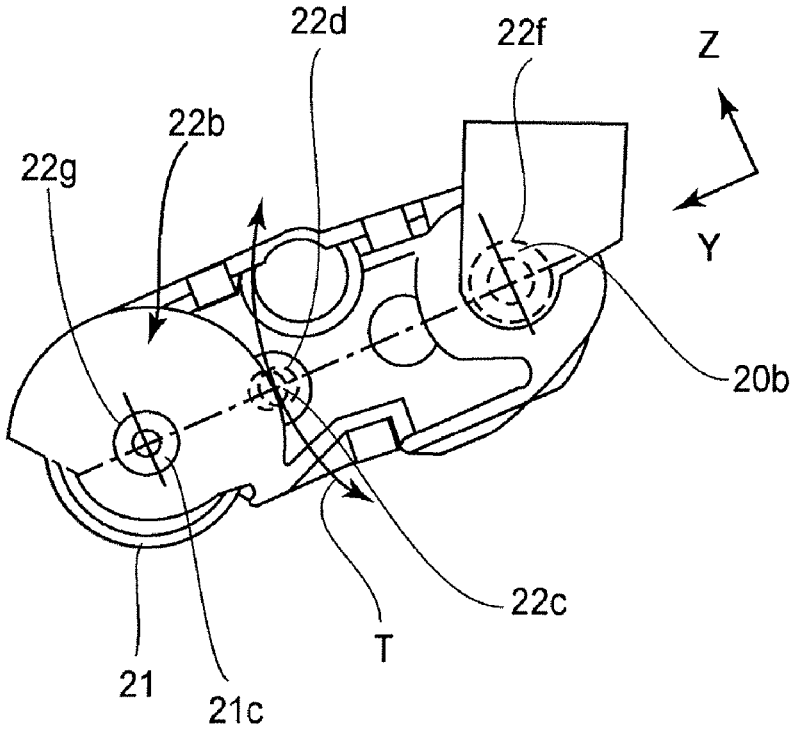
FIG. 4 is a left side view of the sheet feeding means shown in FIG. 3 viewed from 4-4 line side shown in FIG. 3.
Figure 5:
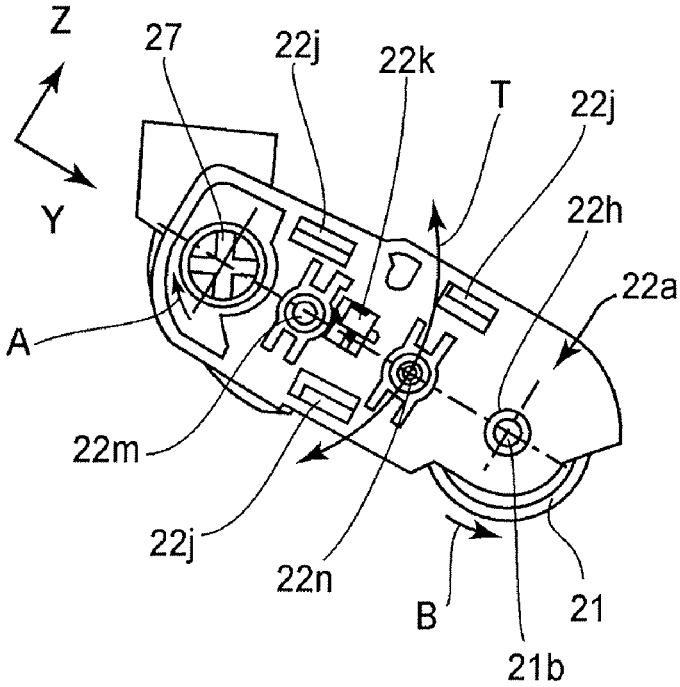
FIG. 5 is a right side view of the sheet feeding means shown in FIG. 3 viewed from 5-5 line side shown in FIG. 3.
Figure 6:
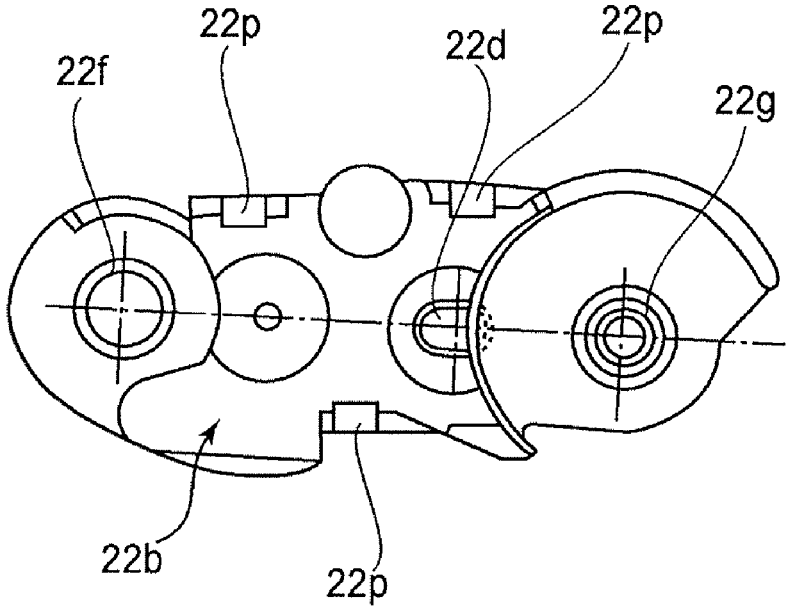
FIG. 6 is an internal view of a second roller supporting member for the swing arm type sheet feeding means shown in FIG. 3 viewed from the inside of the sheet feeding apparatus.
Figure 7:
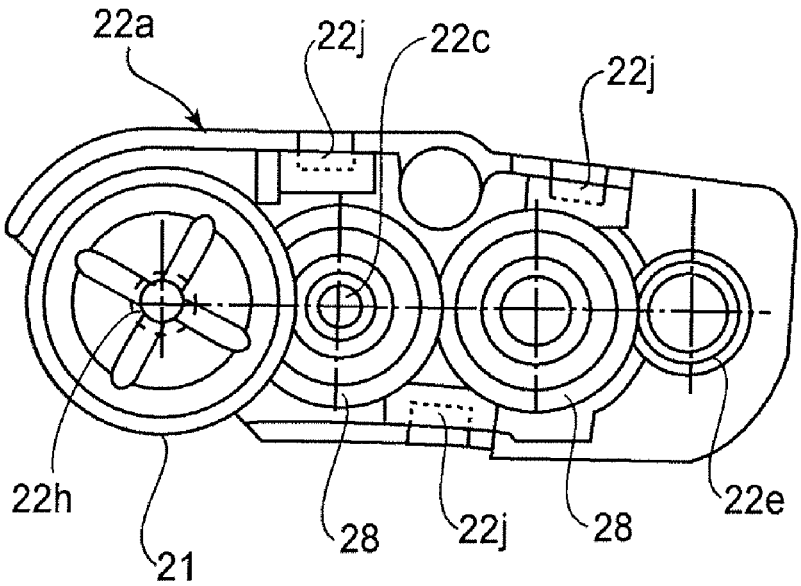
FIG. 7 is an internal view of a first roller supporting member, for the swing arm type sheet feeding means shown in FIG. 3, to which a sheet feeding roller and idler gears are mounted when viewed from the inside of the sheet feeding apparatus.
Figure 8:
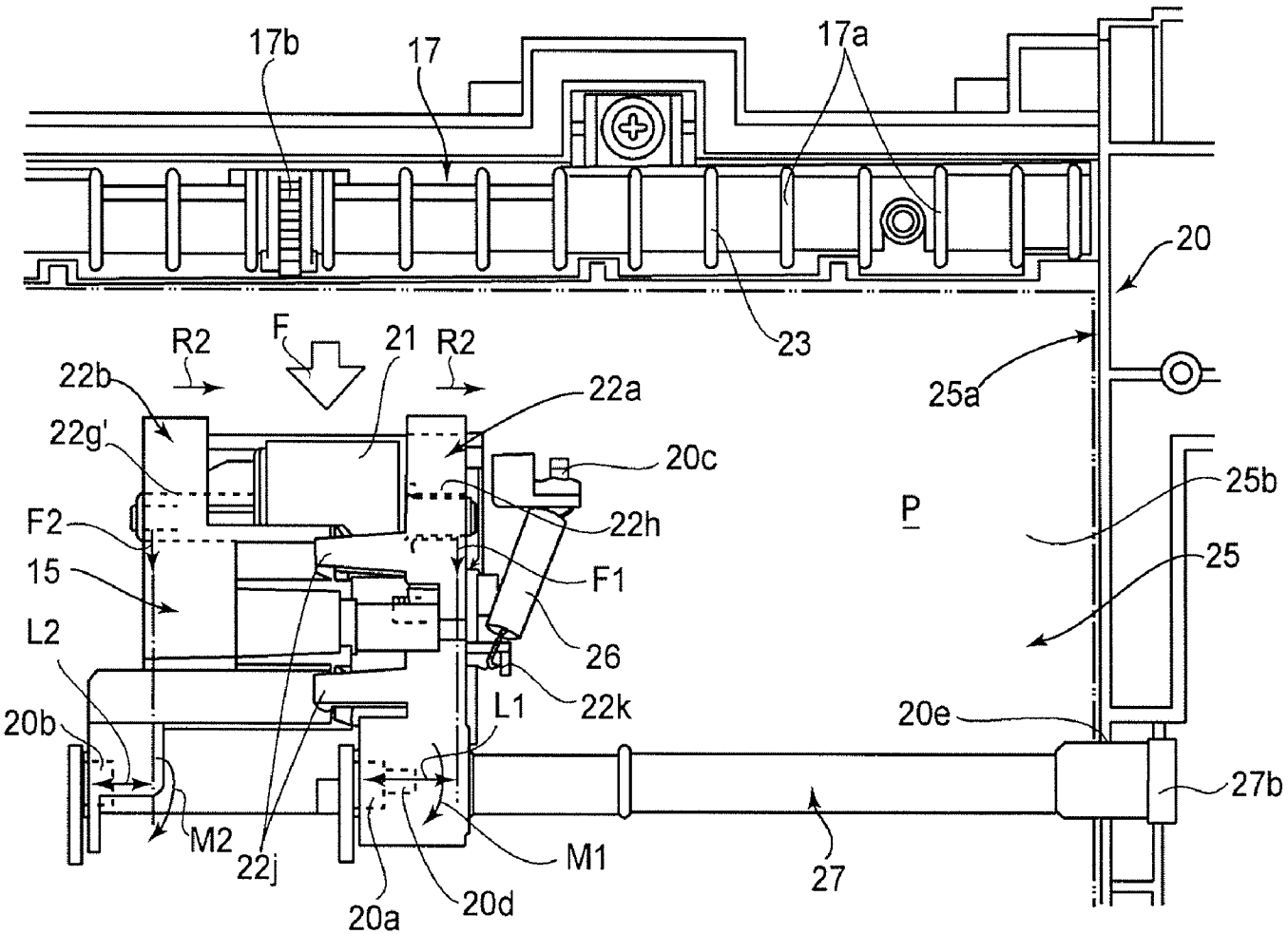
FIG. 8 is a plan view showing a state of the sheet feeding apparatus when stacked sheets are fed.
Figure 9:
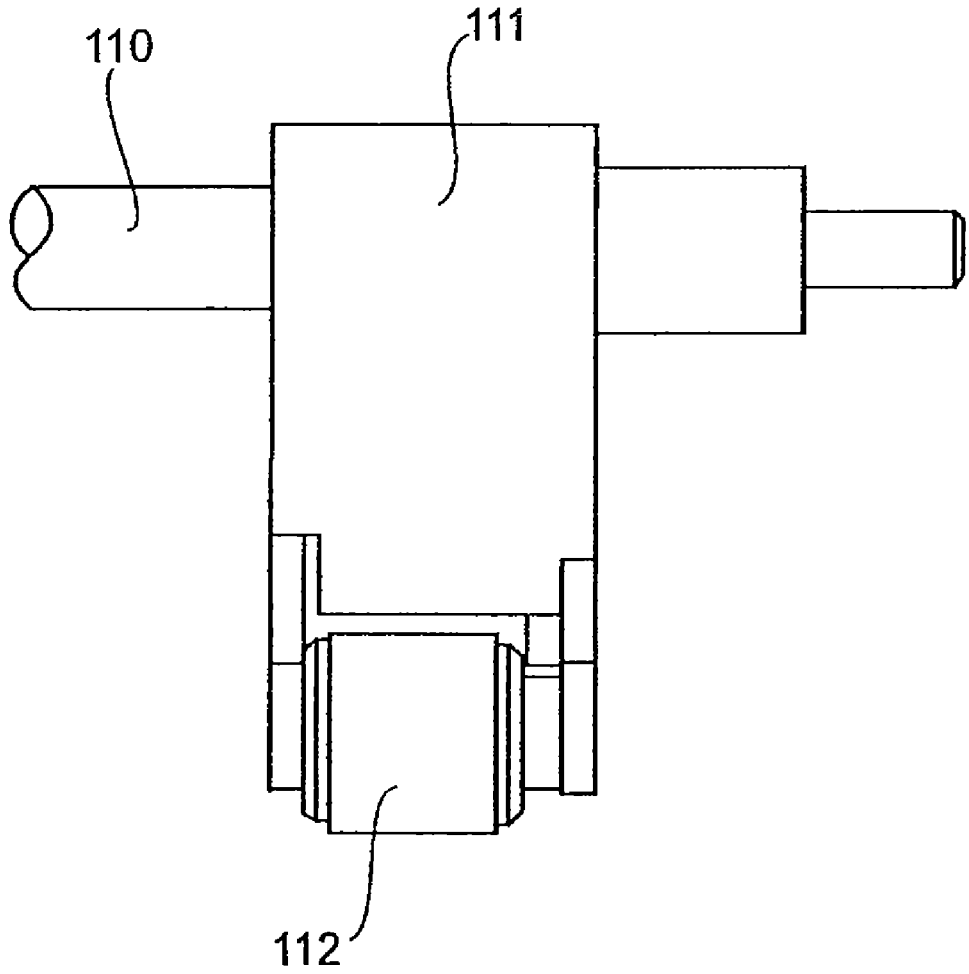
FIG.9 PRIOR ART
FIG. 9 is a front view of a conventional swing arm type sheet feeding means.

FIG. 2 is an exploded perspective view showing constitutional parts of a swing arm type sheet feeding means shown in FIG. 1. FIG. 3 is a plan view showing a state in which the swing arm type sheet feeding means shown in FIG. 2 is supported by the supporting shafts of the sheet feeding base. FIG. 4 is a left side view of the sheet feeding means shown in FIG. 3 viewed from 4-4 line side shown in FIG. 3. FIG. 5 is a right side view of the sheet feeding means shown in FIG. 3 viewed from 5-5 line side shown in FIG. 3. FIG. 6 is an internal view of the left arm of the swing arm viewed from the inside of the sheet feeding apparatus. FIG. 7 is an internal view of the right arm of the swing arm to which the sheet feeding roller and the idler gears are mounted when viewed from the inside of the sheet feeding apparatus. FIG. 8 is a plan view showing a state of the sheet feeding apparatus when stacked sheets are fed.

Next, a constitution of the sheet feeding/separating portion will be described. The sheet feeding roller 21 is provided with a sheet feeding roller gear 21*a* at an end thereof. The swing arm 22 is constituted by the right arm 22*a* and the left arm 22*b* rotatable about the same rotation axis (shaft) in combination. Between a hook portion 20*c* of the sheet feeding base 20 and a hook portion 22*k* of the right arm 22*a*, an urging spring 26 is stretched. This urging spring 26 generates a moment, with respect to a predetermined direction, about a rotation center of the swing arm 22 in correspondence with the rotation of the swing arm 22 by vertical movement of the sheet feeding roller 21 caused depending on a change in amount of the stacked sheets P. By providing such an urging spring 26, it is possible to add a further moment in addition to a self-weight moment thereby to ensure a sheet feeding force when an amount of the stacked sheets is large. On the other hand, when the sheet feeding roller 21 is lowered to the sheet stacking surface 25*b* or a position close to the sheet stacking surface 256, by generating a moment with respect to a direction in which the self-weight moment is cancelled, it is possible to easily set even a small amount of sheets on the sheet stacking surface 25*b* without causing buckling or the like.

A driving shaft 27 is provided with an output gear portion 27*a* at one end portion thereof and an input gear portion 27*b*, at the other end portion thereof, for transmitting a driving force from an unshown driving source to the driving shaft 27. The driving shaft 27 is coaxially disposed with the rotation shafts 20*a* and 20*b* of the swing arm 22 and transmits the driving force from the co-axial output gear portion 27*a* to the sheet feeding roller gear 21*a* through two idler gears 28. The output gear portion 27*a* of the driving shaft 27 is supported by being rotatably engaged with a projection shaft 20*d* formed at an end of the supporting shaft 20*a* provided to the sheet feeding base 20. The driving shaft 27 is rotatably supported in a shaft-supporting hole 20*e* provided in the sheet feeding base 20 in the neighborhood of the input gear portion 27*b* as shown in FIG. 8. When the driving shaft 27 is rotationally driven in a (clockwise) direction indicated by an arrow A shown in FIG. 5, its rotational force is transmitted to the sheet feeding roller gear 21*a* through the output gear portion 27*a* and the two idler gears 28. As a result, the sheet feeding roller 21 is rotationally driven in a (counterclockwise) direction, indicated by an arrow B shown in FIG. 5, corresponding to a sheet feeding direction.

In the neighborhood of the end portion of the sheet stacking portion 25, a separating means 17 functioning as the leading end reference portion 23 for holding the leading ends of the stacked sheets is provided. The separating means 17 is constituted, as shown in FIGS. 1 and 8, by a plurality of ribs having an inclined surface 17*a* including portions provided at a predetermined interval with respect to a sheet width direction. In this embodiment, at an intermediary position with respect to the sheet width direction of the separating means 17, a projection/recess inclined surface 17*b* which is inclined at the same angle as that of the inclined surface 17*a* is provided. This projection/recess inclined surface 17*b* is constituted by arcuate projections formed with a predetermined pitch with respect to the sheet feeding direction and recesses (valley portions) between the projections and is disposed at a position higher than a position of the inclined surface 17*a*. The projection/recess inclined surface 17*b* is constituted so that the uppermost sheet of the sheets fed by the sheet feeding roller 21 can be fed by a sheet feeding force of the sheet feeding roller 21. Further, the projection/recess inclined surface 17*b* acts on fed second and subsequent sheets so that leading ends of the sheets strike against the recesses of the projection/recess inclined surface 17*b* to stop at positions of the recesses by a small frictional force between adjacent sheets and a resistance by the projection/recess inclined surface.

The separated uppermost sheet is fed through a U-turn reverse feeding path 29 shown in FIG. 1. This sheet is further sent to the nip between the conveying roller 31 and the pinch roller 32 via a horizontal feeding path 41 formed at a lower portion of a second sheet feeding apparatus 40.

Thereafter, the sheet is conveyed to the recording portion or reading portion 50 by rotation of the conveying roller 31. At a position downstream from the recording portion 50 with respect to the sheet feeding direction, the sheet discharge roller 33 synchronously driven with the conveying roller 31 and the spur 34 pressed against the sheet discharge roller 33 are disposed. With respect to the sheet conveyed through the recording portion or reading portion 50 via the nip between the conveying roller 31 and the pinch roller 32 and the nip between the sheet discharge roller 33 and the spur 34, image recording or image reading is effected. The image recording is effected by an unshown recording head driven on the basis of image information. The reading of an image formed on an original (the sheet) is effected by a reading operation of the original (sheet) by using a contact image sensor. The sheet subjected to the image recording or the image reading is discharged to the outside of the main assembly of the sheet feeding apparatus by the sheet discharge roller 33 and the spur 34.

Next, a constraint relationship between the right arm 22*a* and the left arm 22*b* in an assembly state in the swing arm type sheet feeding means 15 will be described. To the right arm 22*a*, a shaft-supporting hole 22*h* for rotatably supporting the sheet feeding roller 21 and a shaft-supporting hole 22*e* rotatably engaged with the supporting shaft 20*a* of the sheet feeding base 20 are provided. Further, to the right arm 22*a*, supporting shafts 22*m* and 22*n* for rotatably supporting the two idler gears 28 are provided. The right arm 22*a* is further provided with a boss 22*c* as a projection shaft. The left arm 22*b* is provided with an elongated hole 22*d* slidably engageable with the boss 22*c* when the left arm 22*b* is combined with the right arm 22*a* to constitute the swing arm type sheet feeding means 15.

At three positions at an inner surface of the right arm 22*a*, temporary assembling hooks 22*j* protruded toward the left arm 22*b* are provided. On the other hand, to the left arm 22*b*, engaging portions 22*p* constituted by recesses or openings engageable with the temporary assembling hooks 22*j*, respectively, are provided. In this embodiment, the temporary assembling hooks 22*j* and the engaging portions 22*p* are respectively provided at upper two positions and a lower one position (three positions in total) for each of the right arm 22*a* and the left arm 22*b*. These three temporary assembling hooks 22*j* and three engaging portions 22*p* prevent internally assembled parts from dropping off when the right arm 22*a* and the left arm 22*b* are assembled to constitute the swing arm type sheet feeding means 15.

To the left arm 22*b*, a shaft-supporting hole 22*g* for rotatably supporting the sheet feeding roller 21 and a shaft-supporting hole 22*f* for being rotatably engaged with the supporting shaft 20*b* of the sheet feeding base 20 are provided. The elongated hole 22*d* provided to the left arm 22*b* has a direction of a line connecting the shaft-supporting hole 22*f* with the shaft-supporting hole 22*g* as a longitudinal direction and has a widthwise direction in which the elongated hole 22*d* has a width larger than an outer diameter of the boss (protruded shaft) 22*c* of the right arm 22*a* by engaging play.

When the left arm 22*b* is assembled to the right arm 22*a* shaft-supporting the sheet feeding roller and the idler gears, the sheet feeding roller 21 is rotatably supported by the shaft-supporting hole 22*g* of the left arm 22*b* and the shaft-supporting hole 22*h* of the right arm 22*a*. At the same time, the boss 22*c* of the right arm 22*a* is slidably engaged with the elongated hole 22*d* of the left arm 22*b*. In the assembled state, the right arm 22*a* and the left arm 22*b* are held in an assembly state such that the three temporary assembling hooks 22*j* are engaged with the corresponding engaging portions 22*p* so as not to be mutually deviated or moved apart from each other. That is, in the assembled state of the right arm 22*a* and the left arm 22*b*, motions of the right and left arms 22*a* and 22*b* are constrained only by the boss 22*c* and the elongated hole 22*c* in addition to the temporary assembling hooks 22*j*. In such a state, between the right arm 22*a* and the left arm 22*b*, a large degree of freedom (latitude) is provided with respect to a direction of a line connecting the shaft-supporting holes 22*f* and 22*g* (or the shaft-supporting holes 22*e* and 22*h*). At the same time, with respect to each of rotational directions of the right and left arms, a degree of freedom corresponding to engaging play of each of the shaft-supporting holes about the boss 22*c* is provided.

Next, with reference to FIGS. 3-5, a state in which the swing arm type sheet feeding means 15 constituted by assembling the right and left arms as described above is attached to the supporting portion including the supporting shafts 20*a* and 20*b* of the sheet feeding base 20 will be described. The swing arm type sheet feeding means 15 is attached to the sheet feeding base 20 in such a state that the shaft-supporting holes 22*e* and 22*f* are rotatably fitted around the supporting shafts 20*a* and 20*b*. Of parts of the swing arm type sheet feeding means 15, the right arm 22*a* and the left arm 22*b* are assembled only by engagement between the boss 22*c* and the elongated hole 22*d*. For this reason, the right arm 22*a* has a degree of freedom about Z-axis shown in FIGS. 4 and 5 with respect to a direction indicated by a double-pointed arrow R shown in FIG. 3. Further, the left arm 22*b* has a degree of freedom about the Z-axis shown in FIGS. 4 and 5 with respect to a direction indicated by a double-pointed arrow S shown in FIG. 3.

The swing arm type sheet feeding means 15 has no means for connecting the right and left arms in X-axis direction (left-right direction) shown in FIG. 3, so that the right arm 22*a* has an independent degree of freedom with respect to each of two directions indicated by the arrow R and the left arm 22*b* has an independent degree of freedom with respect to each of two directions indicated by the arrow S. In this case, a maximum degree of freedom corresponds to engaging play between the shaft-supporting hole 22*e* and the supporting shaft 20*a* for the right arm 22*a* and engaging play between the shaft-supporting hole 22*f* and the supporting shaft 20*b* for the left arm 22*b*.

On the other hand, as for a degree of freedom about the supporting portion constituted by the supporting shafts shown in FIGS. 3-5 with respect to a rotational direction about X-axis shown in FIG. 3, the elongated hole 22*d* and the boss 22*c* are placed in the engaged state, so that there is no degree of freedom larger than engaging play with respect to a direction indicated by a double-pointed arrow T shown in FIGS. 4 and 5. For this reason, a degree of freedom about X-axis, i.e., a degree of freedom with respect to the rotational direction indicated by the double-pointed arrow T is very small. As a result, the right arm 22*a* and the left arm 22*b* are substantially placed in an integrally movable state, i.e., a mutually constrained state.

That is, in the swing arm type sheet feeding means 15 in this embodiment, with respect to the rotational direction about X-axis shown in FIG. 3, the right arm 22*a* and the left arm 22*b* are not connected to each other, thus being independently movable, i.e., independently having the degree of freedom. However, with respect to a swing direction (rotational direction) about X-axis indicated by the arrow T with the supporting shafts 20*a* and 20*b* as a center, the right arm 22*a* and the left arm 22*b* are substantially placed in a mutually constrained state.

Next, an attitude of the swing arm type sheet feeding means 15 and a sheet movement direction during the sheet feeding operation in the sheet feeding apparatus according to this embodiment will be described. Referring to FIG. 8, the sheet stacking portion 25 has a sheet feeding reference surface 25*a* for guiding a sheet P to be fed while regulating a widthwise directional position of the sheet P. When the sheet feeding operation by the sheet feeding roller 21 is started, the sheet feeding roller 21 is subjected to a feeding resistive force indicated by an arrow F from the sheet P. The feeding resistive force F acts on the swing arm type sheet feeding means 15 as a component force F1 exerted on the shaft supporting hole 22*h* of the right arm 22*a* and a component force F2 exerted on the shaft supporting hole 22*g* of the left arm 22*b*. Here, F=F1+F2 is satisfied.

As a result, with respect to the right arm 22*a*, by the component force F1, moment M1=F1×L1 acts. At the same time, with respect to the left arm 22*b*, by the component force F2, moment M2=F2×L2 acts. In this embodiment, the shaft-supporting portions for the right and left arms are constituted so that each of the moment M1 and the moment M2 acts clockwise as indicated by the arrow therefor. For this reason, on each of the right arm 22*a* and the left arm 22*b*, a clockwise force indicated by the arrow is exerted. Incidentally, in the swing arm type sheet feeding means 15, as described above, with respect to the clockwise direction indicated by the arrow shown in FIG. 8, the degree of freedom corresponding to the engaging play is present about each of the supporting shafts 20*a* and 20*b* of the sheet feeding base 20 as the rotation center. That is, as shown in FIG. 3, the right arm 22*a* and the left arm 22*b* have the degree of freedom indicated by the double-pointed arrow R and the degree of freedom indicated by the double-pointed arrow S, respectively. For this reason, as a result, the swing arm type sheet feeding means 15 is rotated in the clockwise direction in a small amount.

As the result of the clockwise rotation of the swing arm type sheet feeding means in the small amount, the sheet feeding roller 21 is finally moved substantially parallel from a free position in a direction indicated by an arrow R2. That is, in this embodiment, the sheet feeding roller 21 is subjected to the feeding resistive force F from the sheet P after the sheet feeding operation is started, so that the sheet feeding roller 21 is moved substantially parallel from a free position before the sheet feeding operation. By this substantially parallel movement of the sheet feeding roller 21, the sheet P is forcedly moved toward the sheet feeding reference surface and moved in a straight line along the sheet feeding reference surface. By employing such a constitution, it is possible to move an edge portion of the sheet P along the sheet feeding reference surface with reliability. For this reason, it is possible to prevent oblique movement of the sheet P during the sheet feeding operation to realize a stable sheet feeding operation.

A press-contact force exerted from the sheet feeding roller 21 on the sheet P when the sheet P is fed by the swing arm type sheet feeding means 15 in this embodiment will be described. The press-contact force acting on the sheet P during the sheet feeding operation is generated by transmitting a driving force from the output gear portion 27*a* of the driving shaft 27 to the idler gears 28 attached to the right arm 22*a* and the sheet feeding roller gear 21*a* provided at an end of the sheet feeding roller 21. More specifically, the press-contact force exerted from the sheet feeding roller 21 on the sheet P is generated by a force acting on the idler gears 28 and the sheet feeding roller gear 21*a* to press the right arm 22*a* against the sheet P. The thus generated force with respect to the press-contact direction is transmitted to the left arm 22*b* via a constraint portion constituted by the boss 22*c* and the elongated hole 22*d*.

As described above, with respect to the direction about X-axis with the supporting shafts 20*a* and 20*b* as the rotation center (the direction indicated by the double-pointed arrow T shown in FIGS. 4 and 5), there is no degree of freedom more than the engaging play between the boss 22*c* and the elongated hole 22*d*. For this reason, the right arm 22*a* and the left arm 22*b* are substantially placed in a mutually constrained state. Accordingly, in the swing arm type sheet feeding means

15 of this embodiment, the press-contact force generated with respect to the right arm 22*a* can be efficiently transmitted to the left arm 22*b*. For this reason, with respect to right and left shaft portions 21*b* and 21*c* of the sheet feeding roller 21, the press-contact force can be caused to act substantially uniformly.

By employing the above described constitution, it is possible to cause the press-contact force to act on the sheet feeding roller 21 substantially uniformly with respect to the left-right direction. As a result, it is possible to prevent the oblique movement of the sheet during the sheet feeding operation to realize the stable sheet feeding operation. Further, the sheet feeding roller can contact the stacked sheets with a proper press-contact force. At the same time, it is also possible to maintain perpendicularity of the sheet feeding roller with respect to the sheet feeding direction. As a result, it is possible to suppress deviation of the sheet with respect to a movement direction of the sheet.

Incidentally, the recording portion 50 in the recording apparatus using the sheet feeding apparatus according to the present invention can employ various recording methods. As the recording apparatus using the sheet feeding apparatus of the present invention, for example, in addition to an ink jet recording apparatus for effecting recording by ejecting ink from ejection outlets of a recording head onto a sheet, it is possible to employ the following recording apparatuses. For example, it is possible to adopt recording apparatuses of various types such as a laser beam type, a thermal transfer type, a heat-sensitive type, and a wire dot type. Further, the recording portion may be of any type of a serial type for effecting recording with a recording head mounted on a reciprocating carriage and a line type for effecting recording with a recording head extended in a widthwise direction of a recording medium only by performing subscanning (feeding) of the recording medium. Further, a recording apparatus or an image forming apparatus which use the sheet feeding apparatus of the present invention may be a single apparatus or a multi-function equipment or system constituted by integrating the single apparatus with another apparatus or a plurality of equipment. The present invention is similarly applicable to these apparatuses (systems).

According to the present invention, it is possible to provide a sheet feeding apparatus capable of realizing a stable sheet feeding operation such that the sheet feeding roller can be caused to press-contact the sheet uniformly with respect to the left-right direction of the sheet to prevent oblique movement of the sheet.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 187920/2006 filed Jul. 7, 2006, which is hereby incorporated by reference.

What is claimed is:

1. A sheet feeding apparatus comprising:

a sheet stacking portion for stacking a sheet;

a sheet feeding roller for feeding the sheet stacked on said sheet stacking portion;

a first arm, disposed rotatably about a supporting portion, for rotatably supporting said sheet feeding roller, wherein said first arm has a boss; and a second arm, disposed rotatably about said supporting portion, for rotatably supporting said sheet feeding roller, wherein said second arm has an elongated hole slidably engageable with the boss;

wherein said elongated hole engages with the boss with respect to a rotational direction of said first and second arms rotatable about said supporting portion, wherein said elongated hole has a length, with respect to a direction of a straight line connecting a rotation center of said supporting portion and a rotation center of said sheet feeding roller, larger than an outer diameter of the boss and wherein during sheet feeding operation, moments generated by resistance provided from the sheet to said sheet feeding roller, with respect to said first arm and said second arm about an axis normal to a surface of the sheet stacked on said sheet stacking portion at said supporting portion as a rotation center, have the same direction.

2. An apparatus according to claim 1, wherein said sheet stacking portion has a sheet feeding reference surface, and wherein said first arm is disposed close to said sheet feeding reference surface.

3. An apparatus according to claim 2, wherein between said first arm and a sheet feeding portion for supporting said sheet stacking base, an urging spring is stretched.

4. A recording apparatus for effecting recording on a sheet with a recording head, comprising:

a carriage movable while mounting thereon the recording head;

a sheet stacking portion for stacking a sheet;

a sheet feeding roller for feeding the sheet stacked on said sheet stacking portion;

a first arm, disposed rotatably about a supporting portion, for rotatably supporting said sheet feeding roller, wherein said first arm has a boss;

a second arm, disposed rotatably about said supporting portion, for rotatably supporting said sheet feeding roller, wherein said second arm has an elongated hole slidably engageable with the boss;

wherein said elongated hole engages with the boss with respect to a rotational direction of said first and second arms rotatable about said supporting portion, wherein said elongated hole has a length, with respect to a direction of a straight line connecting a rotation center of said supporting portion and a rotation center of said sheet feeding roller, larger than an outer diameter of the boss and wherein during sheet feeding operation, moments generated by resistance provided from the sheet to said sheet feeding roller, with respect to said first arm and said second arm about an axis normal to a surface of the sheet stacked on said sheet stacking portion at said supporting portion as a rotation center, have the same direction.

5. An apparatus according to claim 4, wherein said sheet stacking portion has a sheet feeding reference surface, and wherein said first arm is disposed close to said sheet feeding reference surface.

6. An apparatus according to claim 5, wherein between said first arm and a sheet feeding base for supporting said sheet stacking portion, an urging spring is stretched.

7. A sheet feeding apparatus comprising:

a sheet stacking portion for stacking a sheet;

a roller for feeding the sheet stacked on said sheet stacking portion;

an arm including a holding portion for holding a rotational axis of said roller;

a supporting portion for swingably supporting said arm, said supporting portion rotatably supporting said arm about an axis with respect to a direction of a normal to a surface of the sheet stacked on said sheet stacking portion; and a reference surface for regulating a position of a side end portion of the sheet stacked on said sheet stacking portion;

wherein said holding portion is located closer to the reference surface than said supporting portion so that a reaction force exerted from the sheet to said roller when the sheet is fed generates a moment in a direction in which said arm is rotated, about the axis with respect to the direction of the normal to a surface of the sheet stacked on said sheet stacking portion with said supporting portion as a rotation center, to move said roller toward the reference surface.

8. A sheet feeding apparatus comprising:

a sheet stacking portion for stacking a sheet;

a roller for feeding the sheet stacked on said sheet stacking portion;

a first arm including a first holding portion for holding a rotational axis of said roller;

a second arm including a second holding portion for holding the rotational axis of said roller;

a first supporting portion for swingably supporting said first arm, said first supporting portion rotatably supporting said first arm about an axis with respect to a direction of a normal to a surface of the sheet stacked on said sheet stacking portion;

a second supporting portion for swingably supporting said second arm, said second supporting portion rotatably supporting said second arm about the axis with respect to the direction of the normal to the surface of the sheet stacked on said sheet stacking portion; and a reference surface for regulating a position of a side end portion of the sheet stacked on said sheet stacking portion;

wherein said first holding portion is located closer to the reference surface than said first supporting portion so that a reaction force exerted from the sheet to said roller when the sheet is fed generates a moment in a direction in which said first arm is rotated, about the axis with respect to the direction of the normal to a surface of the sheet stacked on said sheet stacking portion with said first supporting portion as a rotation center, to move said roller toward the reference surface, and wherein said second holding portion is located closer to the reference surface than said second supporting portion so that a reaction force exerted from the sheet to said roller when the sheet is fed generates a moment in a direction in which said second arm is rotated, about the axis with respect to the direction of the normal to a surface of the sheet stacked on said sheet stacking portion with said second supporting portion as a rotation center, to move said roller toward the reference surface.

* * * * *